United States Patent [19]

Kuzuno et al.

[11] Patent Number: 4,969,831

[45] Date of Patent: Nov. 13, 1990

[54] ADAPTABLE TERMINAL CONNECTOR

[75] Inventors: Katsutoshi Kuzuno; Shigeo Ishizuka; Hiroshi Watanabe, all of Shizuoka, Japan

[73] Assignee: Yazaki Corporation, Tokyo, Japan

[21] Appl. No.: 336,153

[22] Filed: Apr. 11, 1989

[30] Foreign Application Priority Data

Apr. 19, 1988 [JP] Japan ..... 63-51516[U]

[51] Int. Cl.[5] ..... H01R 13/15

[52] U.S. Cl. ..... 439/259; 439/266; 439/654; 439/732; 439/711

[58] Field of Search ..... 439/259, 260, 261, 262, 439/263, 493, 495, 496, 498, 499, 631, 783, 711, 864, 654, 732, 266, 650

[56] References Cited

U.S. PATENT DOCUMENTS

| | | | |
|---|---|---|---|
| 3,070,771 | 12/1962 | Piorunneck | 439/631 X |
| 3,492,538 | 9/1967 | Fergusson | 439/493 X |
| 3,636,499 | 1/1972 | Winklebleck | 439/260 |
| 4,119,357 | 10/1978 | Bonhomme | 439/260 |

FOREIGN PATENT DOCUMENTS

| | | | |
|---|---|---|---|
| 0564675 | 7/1977 | U.S.S.R. | 439/864 |

OTHER PUBLICATIONS

Japanese U.M. Reg. Appln. Laid-Open No. 55-12563, 1-26-1980.

*Primary Examiner*—Neil Abrams
*Assistant Examiner*—Khiem Nguyen
*Attorney, Agent, or Firm*—Armstrong, Nikaido Marmelstein, Kubovcik & Murray

[57] ABSTRACT

A connector comprising a housing having terminal insertion chambers in a jacket body, a terminal connecting shaft which is rotatably mounted between the terminal insertion chambers and so mounted through as to be operable from the outside of the jacket body, and electrically-conductive terminal connecting members disposed on the terminal connecting shaft in the terminal insertion chambers; and a plurality of connectors having terminals disposed in terminal holding chambers open to the outside. The terminals, in the terminal insertion chambers, face each other over the terminal connecting member when the connector is joined to the housing, and are connected to each other by rotating the terminal connecting shaft.

7 Claims, 4 Drawing Sheets

ADAPTABLE TERMINAL CONNECTOR

BACKGROUND OF THE INVENTION

1. Field of the Invention

The present invention relates to a multiple connector for connection of electric wires and, more particularly, to a connector which reduces a connector terminal joining and releasing force and is applicable to various types of connection patterns.

2. Description of the Prior Art

A connector capable of joining and releasing many connector terminals with a little force has been suggested, for example, in Laid-Open Japanese Utility Model Application No. Sho 55-12563.

FIG. 7 is a perspective view showing the connector suggested above. FIG. 8 is a sectional view showing the connector in a joined state. In the connector, a plurality of flexible plate terminals (terminals on the plug side) 24*a* and 24*b*, upper and lower, are disposed opposingly to each other in a plug body 22. Similar plate terminals (terminals on the socket side) 16*a* and 16*b* are disposed opposingly to each other at a narrower spacing than the spacing $\lambda_1$ between the upper and lower terminals 24*a* and 24*b* on the plug side.

Between the upper and lower terminals 16*a* and 16*b* on the socket side is interposed an insulated barlike cam member 17 having an elliptical cross section. Both ends of the cam member 17, which have a round cross section are inserted through the side wall of the socket body 15. On both these ends is rotatably supported a channel-shaped rotating arm 20.

The cam member 17 has a small diameter nearly equal to the spacing $\lambda_2$ between the upper and lower terminals on the socket side 16*a* and 16*b* and a large diameter nearly equal to the spacing $\lambda_1$ between the upper and lower terminals 24*a* and 24*b* on the plug side. The rotating arm 20 is so set as to be held erect in relation to the socket body 15 when the small-diameter section 18 is in contact with the inside surfaces of the upper and lower terminals 16*a* and 16*b* on the socket side.

The rotating arm 20 is provided with cutouts 21 which fit on locking projections 23 projectingly installed on the side walls of the plug body 22.

As the rotating arm 20 is turned downwardly in the direction of the arrow C in FIG. 8 until the cutouts 21 of the rotating arm engage with the locking projections 23 of the plug body 22, the cam member 17 rotates through 90 degrees as indicated by an alternate long and two short dashes line in the drawing, and the large-diameter section 19 of the cam member rotates to expand the terminals 16*a* and 16*b* on the socket side upwardly and downwardly and at the same time the outside surface of the terminals 16*a* and 16*b* on the socket side come in contact with the inside surfaces of the terminals 24*a* and 24*b* on the plug side; namely both the terminals are joined for electrical connection.

In the conventional connectors, electrical connection is made, as described above, by joining a pair of terminals 16*a* and 16*b* on the socket side with the terminals 24*a* and 24*b* on the plug side; accordingly, the connection of the terminals is limited to the opposed two contacts and the direction of connection is also limited to 180 degrees.

Therefore, where it is necessary to lead out the lead-in and lead-out wires in the same direction, or where it is demanded to change the number of wire connectors on the lead-in and lead-out sides, the conventional connectors are not usable.

SUMMARY OF THE INVENTION

In view of the above-described disadvantages inherent in the heretofore known multiple connectors, the present invention has for its object to provide a connector which is capable of reducing a terminal joining and releasing force and also applicable to connection patterns of various combinations of wire lead-in and lead out directions and number of wire connections.

To attain the aforesaid object, the connector according to the present invention comprises a housing A in which terminal insertion chambers 2 are provided in a jacket body 1, a terminal connecting shaft 3 rotatably disposed between the terminal insertion chambers 2 and operably inserted through from the outside of the jacket body 1, and electrically-conductive terminal connecting members 4 mounted on the terminal connecting shaft 3 in the terminal insertion chambers 2, and a plurality of connectors B having terminals in terminal holding chambers 7. When the connector B is joined to the housing A, the terminals 8 in the terminal insertion chambers 2 face each other over the terminal connecting member 4, and are connected to each other when the terminal connecting shaft 3 is rotated.

Next, the function of the present invention will be explained. To connect the connector B of the aforesaid constitution, a plurality of connectors having terminals 8 are inserted into the terminal insertion chambers 2 in the housing A. When the terminal connecting shaft 3 disposed between the terminal insertion chambers 2 is rotated from outside, the electrically-conductive terminal connecting member 4 interposed between the opposing terminals 8 rotates to come into direct contact with the inside surfaces of the opposing terminals, thereby electrically connecting the terminals 8 through the terminal connecting member 4.

In this case, joining the connector B to the housing A having the terminal insertion chambers 2 open in opposite directions or in the same direction allows connection matched to the direction of wires.

Furthermore, rotating a second terminal connecting member 4*c* into contact with either of a pair of terminals 8*c* and 8*d* through a terminal connecting member 4*b*, and further another terminal 8*e* into contact with the second terminal connecting member can connect two lead-out wires 12*c* and 12*e* to one lead-in wire 12*d*.

Other features and advantages of the present invention will become apparent from the following description of the embodiments of the present invention, together with the accompanying drawings.

DESCRIPTION OF THE PREFERRED EMBODIMENT

Figure 1:
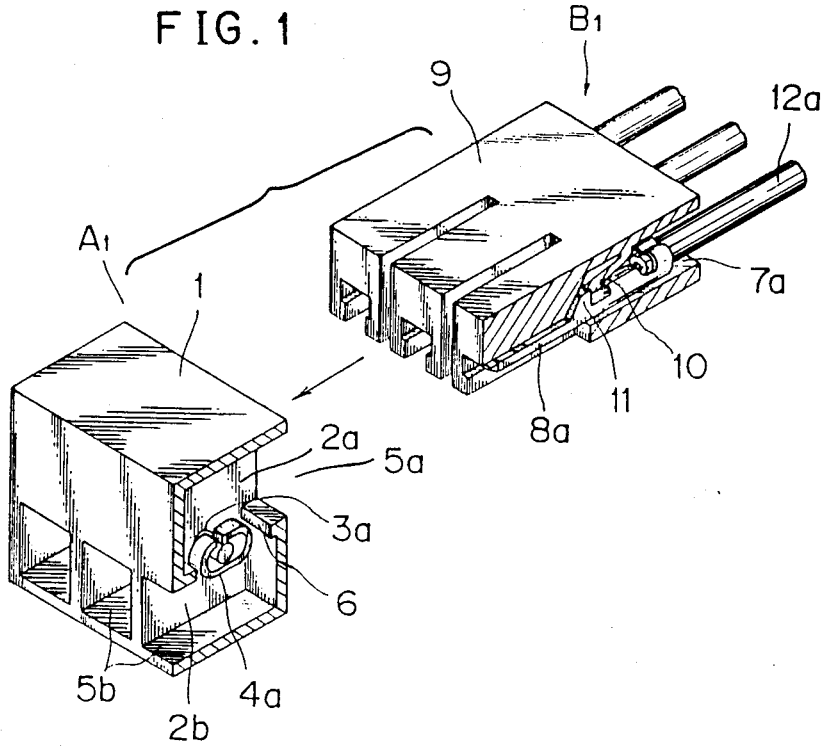
FIG. 1 is an exploded sectional view in perspective of one embodiment of the present invention.

Preferred embodiments of the present invention will now be described by referring to the accompanying drawings. FIG. 1 is a perspective sectional view showing a connector of the present invention. In this drawing, the jacket 1 of the connector housing indicated by $A_1$ is produced from a plastics material, in which a plurality of terminal insertion chambers 2a and 2b are juxtaposed in two stages, upper and lower, open in opposite directions. Between the upper and lower terminal insertion chambers 2a and 2b is mounted an insulated terminal connecting shaft 3a through the side walls of the jacket 1. The terminal connecting shaft 3a has, on its outer peripheral section, an elliptical, conductive terminal connecting member 4a, which rotates as one unit. This terminal connecting member 4a is so designed as to be positioned inside the upper and lower terminal insertion chambers 2a and 2b through a cutout 6 provided in the wall between the upper and lower terminal insertion chambers 2a and 2b.

The terminal connecting member 4a is produced of a resilient sheet metal, insuring contact between the terminals and also serving to maintain a joined state of the jacket and the connector B.

Figure 3:
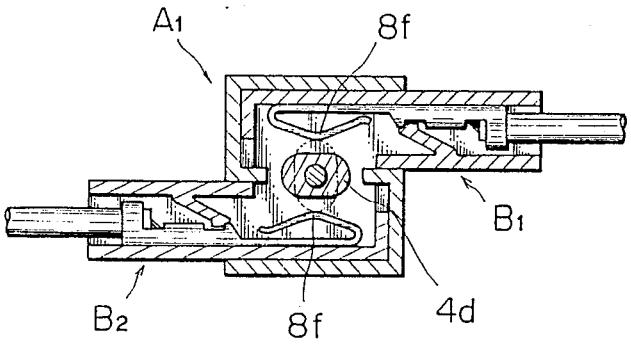
FIG. 3 is a longitudinal sectional view showing another embodiment with modifications of the terminals and the terminal connecting member shown in FIG. 2.

A similar effect of connection can be obtained by using a resilient sheet loop-shaped terminal 8f as shown in FIG. 3 in place of the aforesaid resilient terminal connecting member 4a. (In this case, the terminal connecting member 4d produced of rigid electrically-conductive metal will suffice.)

In FIG. 1, $B_1$ denotes a connector to be joined to the upper terminal insertion chamber 2a in the housing $A_1$. In the plastics jacket 9, a plurality of terminal holding chambers 7a into which the terminals are inserted are juxtaposed. The innermost section of the terminal holding chamber 7a has an opening open to the outside at the lower side. In the upper surface of the inner wall of the terminal holding chamber 7a, there is provided a flexible terminal locking projection 10 bent in the direction to insert the terminal.

A terminal 8a in which a wire 12a is crimped is inserted, with its stopper 11 locked by the locking projection 10, in the terminal holding chamber 7a. The connector inserted into the lower terminal insertion chamber 2b of the housing $A_1$ is of the reversed shape of the connector $B_1$.

Figure 2:
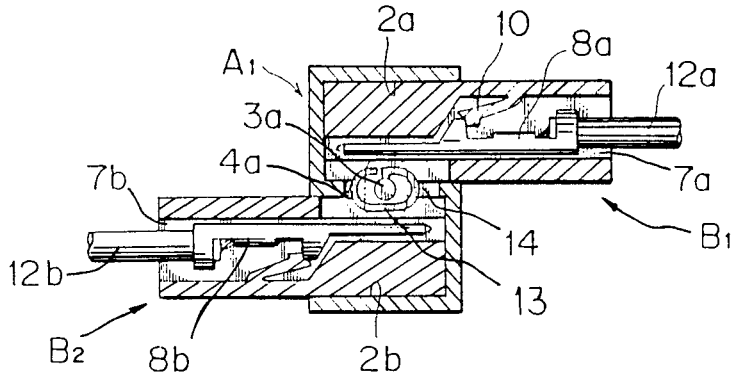
FIG. 2 is a longitudinal sectional view showing a connected state of the connector shown in FIG. 1.

Namely, the connectors $B_1$ and $B_2$ fitted with the terminals 8a and 8b therewithin are plugged into the juxtaposed upper and lower terminal insertion chambers 2a and 2b of the housing $A_1$, facing each other over the terminal connecting member 4a as shown in FIG. 2.

In this drawing, the terminal connecting member 4a is not in contact with both the terminals 8a and 8b, with the surfaces of its small-diameter section 13 facing thereto. Turning the terminal connecting shaft 3a through 90 degrees by the use of a tool such as a screw driver from outside rotates the terminal connecting member 4a until its large-diameter section 14 are in contact with the inside surfaces of the upper terminals 8a and 8b as indicated by an alternate long and two short dashes line in the drawing, thus obtaining the state of electrical connection.

Figure 4:
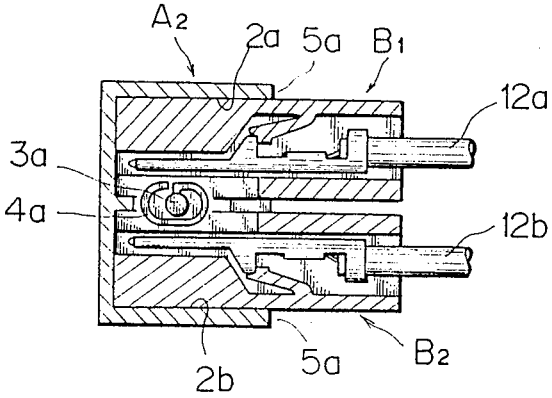
FIG. 4 is a longitudinal sectional view showing a further embodiment with a changed wire lead-out direction of the connector shown in FIG. 2.
Figure 6:
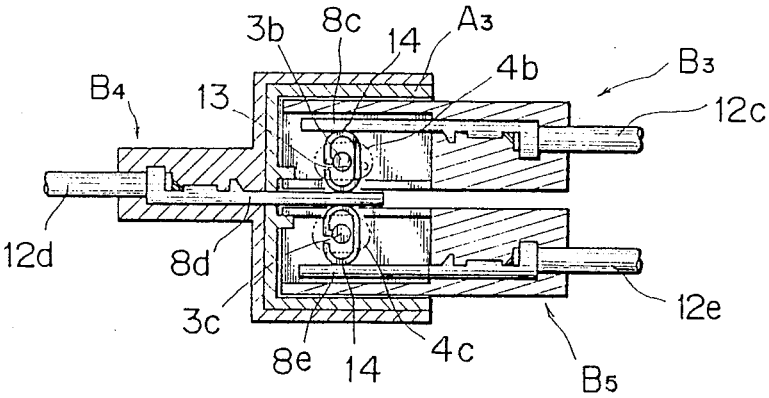
FIG. 6 is a longitudinal sectional view showing the connector shown in FIG. 5 in the connected state.

FIG. 4 shows an embodiment of the present invention in which, unlike the housing $A_1$, the housing $A_2$ has the opening sections 5a and 5b of the juxtaposed upper and lower terminal insertion chambers 2a and 2b on the same side. That is, this connector is used where a lead-in wire 12a and a lead-out wire 12b are plugged in the same direction.

Figure 5:
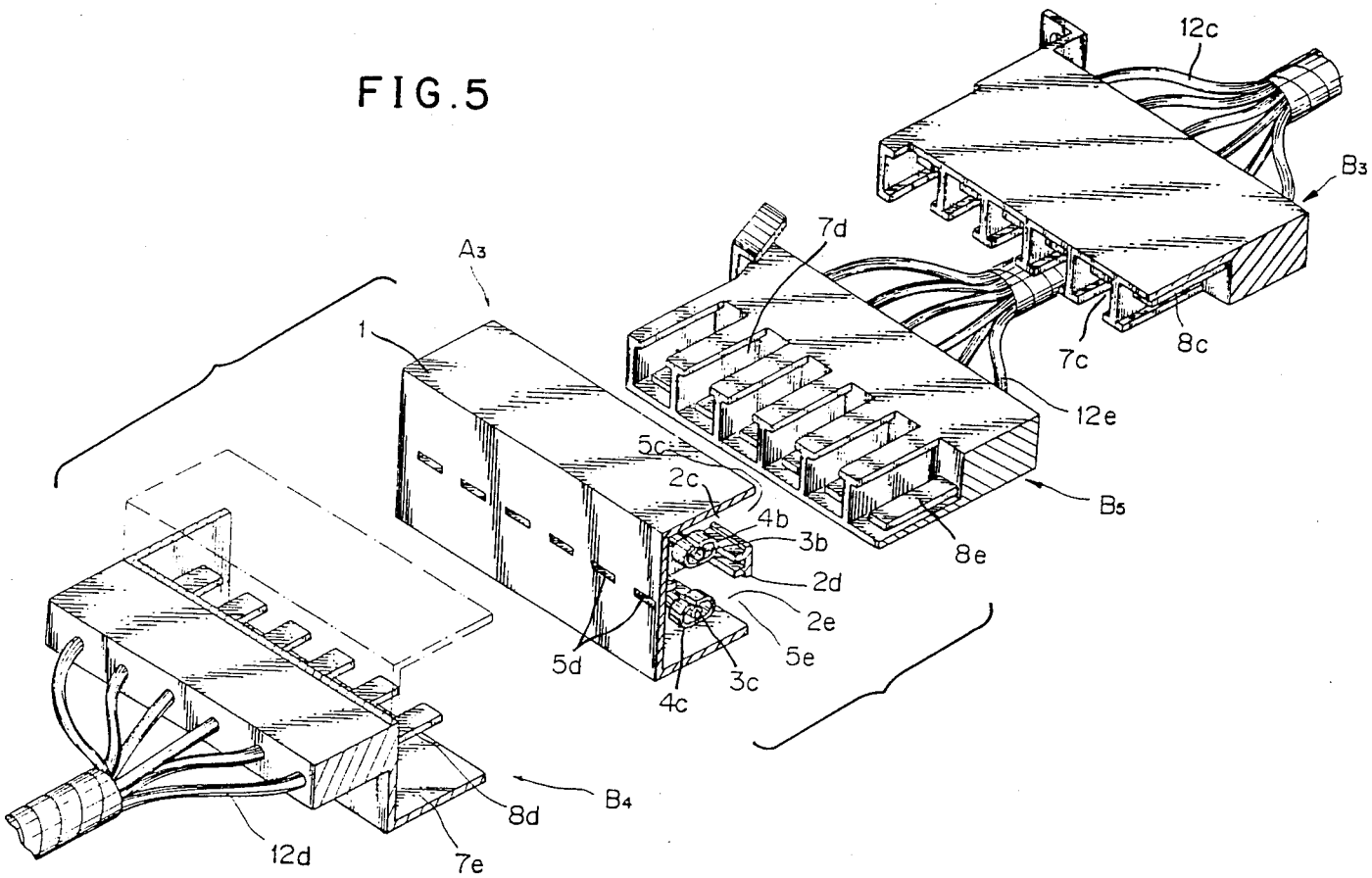
FIG. 5 is an exploded partially sectional view in perspective showing a still further embodiment of the present invention.
Figure 7:
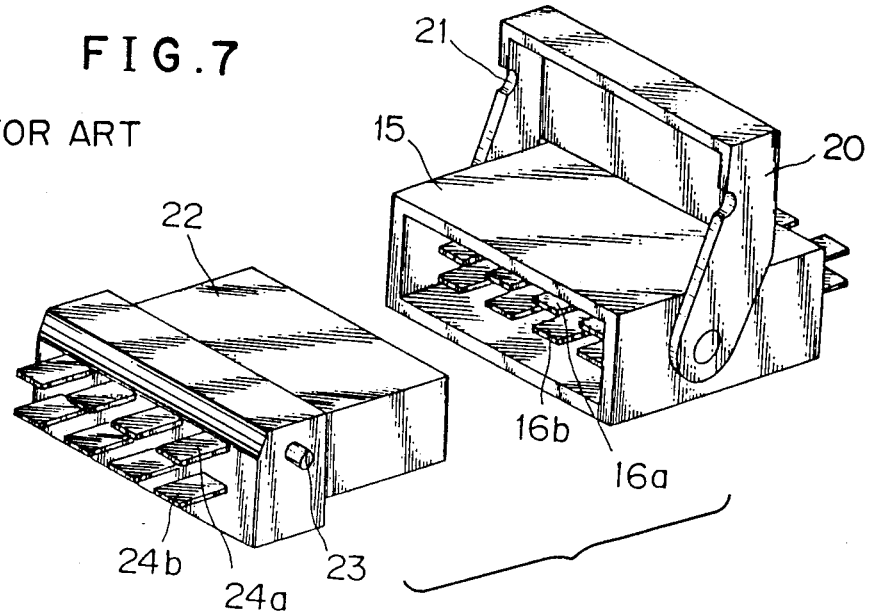
FIG. 7 PRIOR ART
FIG. 7 is a perspective view showing a conventional connector.
Figure 8:
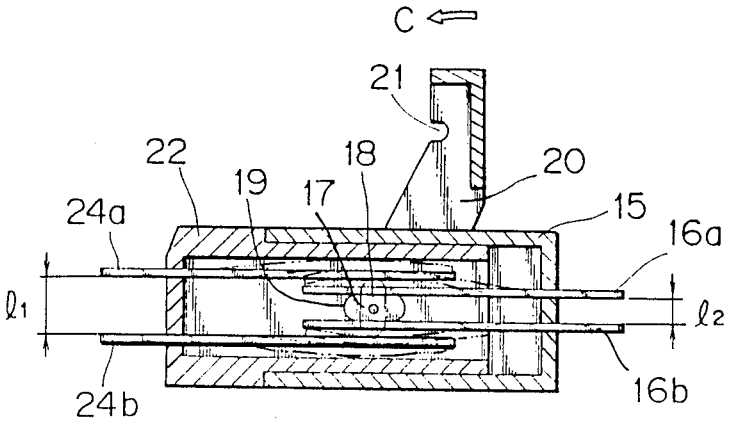
FIG. 8 PRIOR ART
FIG. 8 is a longitudinal sectional view showing the connector shown in FIG. 7 in the connected state.

FIG. 5 shows another embodiment of the present invention, in which a plurality of terminal insertion chambers 2c, 2d and 2e are provided juxtaposed in three stages in the jacket 1 of a housing $A_3$, and terminal connecting shafts 3b and 3c are rotatably inserted between the terminal insertion chambers from the outside of the jacket. The terminal connecting shafts 3b and 3c are provided with electrically-conductive resilient terminal connecting members 4b and 4c like the example shown in FIG. 1.

In this example, the upper stage 2c and the lower state 2e of the terminal insertion chambers are provided in the same direction, while the middle stage 2d is open in the opposite direction. Into opening 5c, 5d and 5e are inserted connectors $B_3$, $B_4$ and $B_5$ having plate terminals 8c, 8d and 8e respectively.

The upper or lower wall of the terminal holding chambers 7c, 7d and 7e of this connector has an opening which opens to the outside in order to allow the contact of the terminal connecting members 4b and 4c with the terminals 8c, 8d and 8e. When the connectors $B_3$, $B_4$ and $B_5$ are joined to the housing $A_3$, a middle terminal 8d goes in between the terminal connecting members 4b and 4c to which a small-diameter section 13 faces (indicated by an alternate long and two short dashes line), such that the upper and lower terminals 8c and 8d are positioned outside of the upper and lower terminals connecting members 4b and 4c respectively.

Turning the upper and lower terminal connecting shafts 3b and 3c through 90 degrees rotates the terminal connecting members 4b and 4c together, bringing the large-diameter section 14 into contact with the terminals 12c, 12d and 12e, thus obtaining electrical connection.

According to this embodiment, two blocks of lead-out connectors $B_3$ and $B_5$ are joined to one block of lead-in connector $B_4$, in which the lead-in wire 12d and lead-out connection wires 12c and 12e are reversed in lead-out directions. In this case also, the connection wires 12c, 12d and 12e can be led out in the same direction by using a housing having terminal insertion chambers 2a and 2b which open in the same direction like the embodiment shown in FIGS. 2 and 4. (Not illustrated)

In the embodiments shown in FIGS. 1 to 6, where the much firmer joining of the connector B to the housing A is required, a lock mechanism or a screw tightening method in conventional use may be adopted.

Since this connector of the present invention does not require a great force for terminal joining, the terminals not only can be joined and released smoothly but can freely set the direction to lead-out wires to be connected to the lead-in and lead out sides and the number of wires to be connected. This, therefore, enables the application of the connector to various connection patterns.

It is to be understood that the above description of the present invention is susceptible to various modifications, changes and adaptations and the same are intended to be comprehended within the meaning and range of equivalents of the appended claims.

What is claimed is:

1. A connector comprising:

a first connector housing having a plurality of elongate terminal insertion chambers arranged parallel to each other therein with each chamber having an opening to provide communication with an adjacent one of said chambers;

a single rotatable shaft extending laterally in said opening and adapted to be operated from outside the first connector housing;

an electrically conductive terminal connecting member provided in said opening and attached to said rotatable shaft for rotation therewith;

at least two second connector housings complementary to said first connector housing and each having terminal holding chambers each holding a terminal therein, each terminal holding chamber having an opening in registry with said opening in said first connector housing when said first and second connector housings are engaged such that the terminal in said each terminal holding chamber of each second connector housing becomes electrically connected to a terminal in one of the terminal holding chambers of another second connector housing by means of said electrically conductive terminal connecting member when said rotatable shaft is operated manually from outside the first connector housing.

2. A connector according to claim 1, wherein adjacent ones of said elongate terminal insertion chambers of the first connector housing having said opening therebetween are adapted to receive at least two connector housings by moving said second connector housings in an identical longitudinal engaging direction.

3. A connector according to claim 1, wherein adjacent one of said elongate terminal insertion chambers of the first connector housing having said opening therebetween are adapted to receive at least two second connector housings by moving said second connector housings in opposite longitudinal engaging directions.

4. A connector according to claim 1, wherein said connector includes at least three second connector housings complimentary to said first connector housing and each having terminal holding chambers each holding a terminal therein and said first connector housing has three juxtaposed elongate terminal insertion chambers to be engaged with said three second connector housings in alternately opposite directions.

5. A connector according to claim 1, wherein said electrically conductive terminal connecting member includes an elliptical member having a large diameter section and a small diameter section, said small diameter section is spaced from the terminal in each terminal holding chamber in one angular position of said elliptical member, said large diameter section contacts the terminal in said each terminal holding chamber in another angular position thereof.

6. A connector according to claim 5, wherein said elliptical member is a resilient member.

7. A connector according to claim 5, wherein said elliptical member is formed of rigid material and the terminal in each terminal holding chamber is formed in a loop to give resiliency thereto.

* * * * *